US006460272B2

(12) United States Patent
Cheng

(10) Patent No.: US 6,460,272 B2
(45) Date of Patent: Oct. 8, 2002

(54) SAFETY HOT AIR BLOWING GUN

(76) Inventor: Chuan-Hsin Cheng, 5F, No.637-1, Sec.5, Chung-Hsin Road, San-chung City, Taipei Hsien (TW)

( * ) Notice: Subject to any disclaimer, the term of this patent is extended or adjusted under 35 U.S.C. 154(b) by 0 days.

(21) Appl. No.: 09/846,531

(22) Filed: Apr. 30, 2001

(65) Prior Publication Data

US 2002/0129512 A1 Sep. 19, 2002

(30) Foreign Application Priority Data

Mar. 14, 2001 (TW) ..... 090203799

(51) Int. Cl.[7] ..... A45D 20/00
(52) U.S. Cl. ..... 34/96; 34/97
(58) Field of Search ..... 34/90, 96, 97, 34/98, 99, 100

(56) References Cited

U.S. PATENT DOCUMENTS 4,668,855 A * 5/1987 Wilson ..... 392/385
4,683,370 A * 7/1987 Petersen ..... 392/385
4,767,914 A * 8/1988 Glucksman ..... 392/383
5,701,681 A * 12/1997 Wonka ..... 34/97
5,996,243 A * 12/1999 Chang ..... 34/97

* cited by examiner

*Primary Examiner*—Ira S. Lazarus
*Assistant Examiner*—Kathryn S. O'Malley

(57) ABSTRACT

A safety hot air blowing gun includes a housing, an inner barrel mounted inside the housing and holding a high-impedance resistance type heating element around the inside wall thereof, a nozzle tip fastened to the front side of the housing, a fan motor assembly mounted inside the housing behind the inner barrel and controlled to blow air through the inside of the inner barrel and the outside of the inner barrel within the housing, and a protective ring mounted within the housing to support the inner barrel, the protective ring having inside protruded portions abutted against the periphery of the inner barrel and defining a plurality of open spaces around the inner barrel for the passing of currents of air from the fan motor assembly to reduce the temperature of the peripheral wall of the inner barrel and to prevent the housing from deformation due to high temperature.

1 Claim, 4 Drawing Sheets

SAFETY HOT AIR BLOWING GUN

BACKGROUND OF THE INVENTION

The present invention relates to a hot air blowing gun and, more particular, to a safety hot air blowing gun, which uses a protective ring to support the inner barrel inside the housing, enabling a part of induced currents of air to pass through open spaces around the inner barrel, so as to minimize transmission of heat from the inner barrel to the housing.

FIG. 1 shows a hot air blowing gun according to the prior art. This structure of hot air blowing gun comprises a housing A, an inner barrel and nozzle assembly C mounted inside the housing A and partially projecting out of the front side of the housing A, a high-impedance resistance type heating element (not shown) wound round the inside wall of the inner barrel and nozzle assembly C, and a fan motor assembly B mounted inside the housing A behind the inner barrel and nozzle assembly C and controlled to blow currents of air through the inner barrel and nozzle assembly C to the outside of the hot air blowing gun for application. This structure of hot air blowing gun is functional, however it has drawbacks. Because the nozzle of the inner barrel and nozzle assembly C projects out of the front side of the housing A, the user may touch the hot nozzle of the inner barrel and nozzle assembly C by an accident during the operation of the hot air blowing gun. During the operation of the hot air blowing gun, the temperature of the high-impedance resistance type heating element is as high as 500~600° C., and the nozzle of the inner barrel and nozzle assembly C is continuously heated by hot air passing through. When touching the hot nozzle of the inner barrel and nozzle assembly C by an accident, the hand will be severely scalded with the hot nozzle. Further, the inner barrel and nozzle assembly C has a metal locating ring C disposed around the periphery and fastened to the inside wall of the housing A. Because the locating ring C is fastened to the inside wall of the housing A, it prohibits cold air from passing through the gap between the outside wall of the inner barrel and nozzle assembly C and the inside wall of the housing A to reduce the temperature of the body of the nozzle of the inner barrel and nozzle assembly C. After a certain length of time in operation, the temperature of the nozzle of the inner barrel and nozzle assembly C may become higher than the melting point of certain materials, for example, wood, plastics, paper, and etc. When touching materials of low melting point with the hot nozzle of the inner barrel and nozzle assembly C, the materials may be burned, causing a disaster.

SUMMARY OF THE INVENTION

The present invention has been accomplished to provide a safety hot air blowing gun, which eliminates the aforesaid drawbacks. It is the main object of the present invention to provide a hot air blowing gun, which minimizes the contact area between the inner barrel and the housing so as to reduce the transmission of heat from the inner barrel to the housing. It is another object of the present invention to provide a hot air blowing gun, which guides a part of the induced currents of air from the fan blade assembly through the space around the inner barrel, so as to reduce the contact temperature between the inner barrel and the housing. According to one aspect of the present invention, the safety hot air blowing gun comprises a housing, an inner barrel mounted inside the housing and holding a high-impedance resistance type heating element around the inside wall thereof, a nozzle tip fastened to the front side of the housing, a fan motor assembly mounted inside the housing behind the inner barrel and controlled to blow air through the inside of the inner barrel and the outside of the inner barrel within the housing, and a protective ring mounted within the housing to support the inner barrel, the protective ring having inside protruded portions abutted against the periphery of the inner barrel and defining a plurality of open spaces around the inner barrel for the passing of currents of air from the fan motor assembly to reduce the temperature of the peripheral wall of the inner barrel and to prevent the housing from deformation due to high temperature. According to another aspect of the present invention, a conical nozzle cap mounted on the front side of the housing around the nozzle tip and adapted to guide currents of air passing through the open spaces to the outside of the housing.

DETAILED DESCRIPTION OF THE PREFERRED EMBODIMENT

Figure 1:
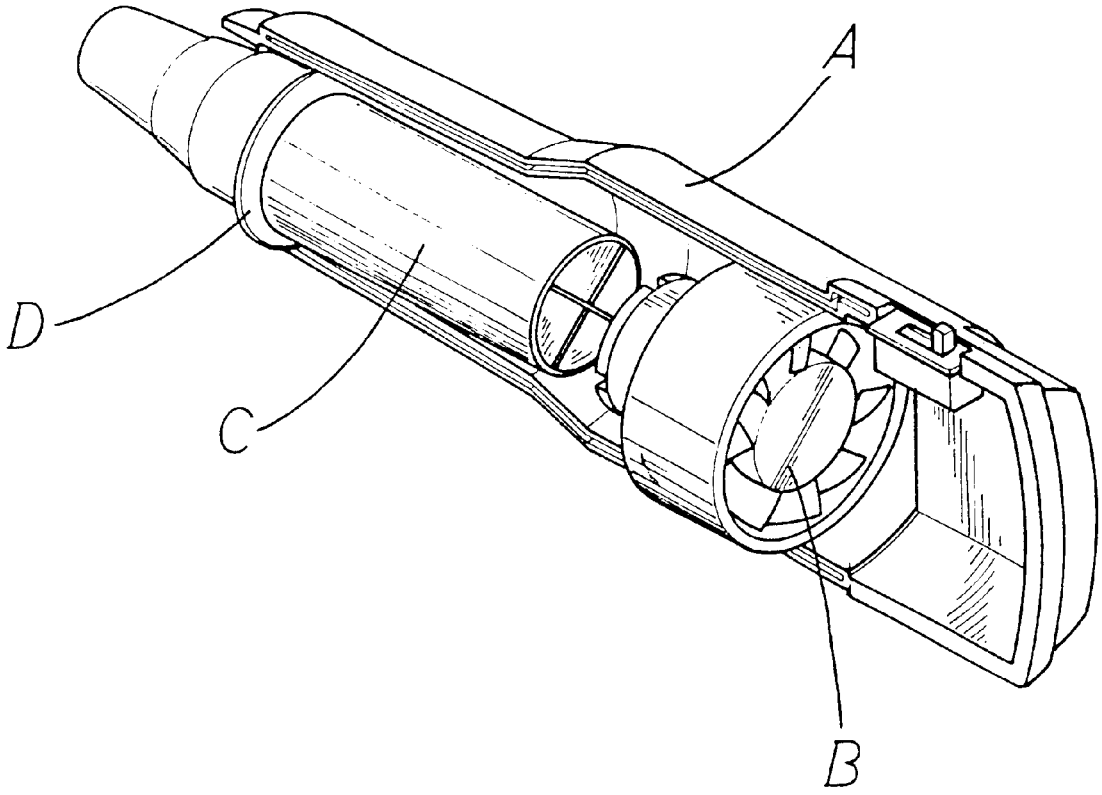
FIG.1 PRIOR ART
FIG. 1 is a cutaway view of a hot air blowing gun according to the prior art.
Figure 2:
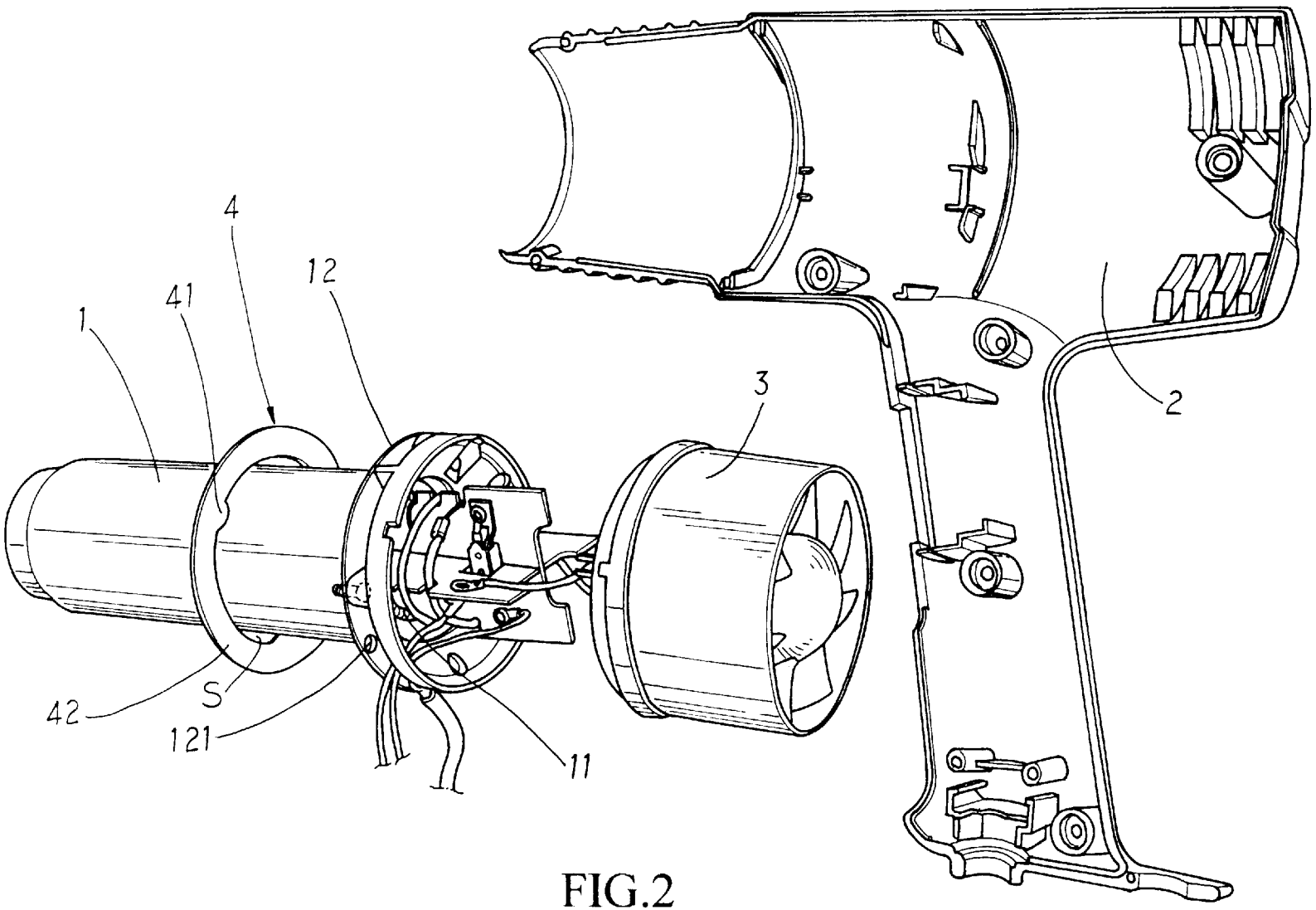
FIG. 2 is an exploded view of a safety hot air blowing gun according to the present invention.
Figure 3:
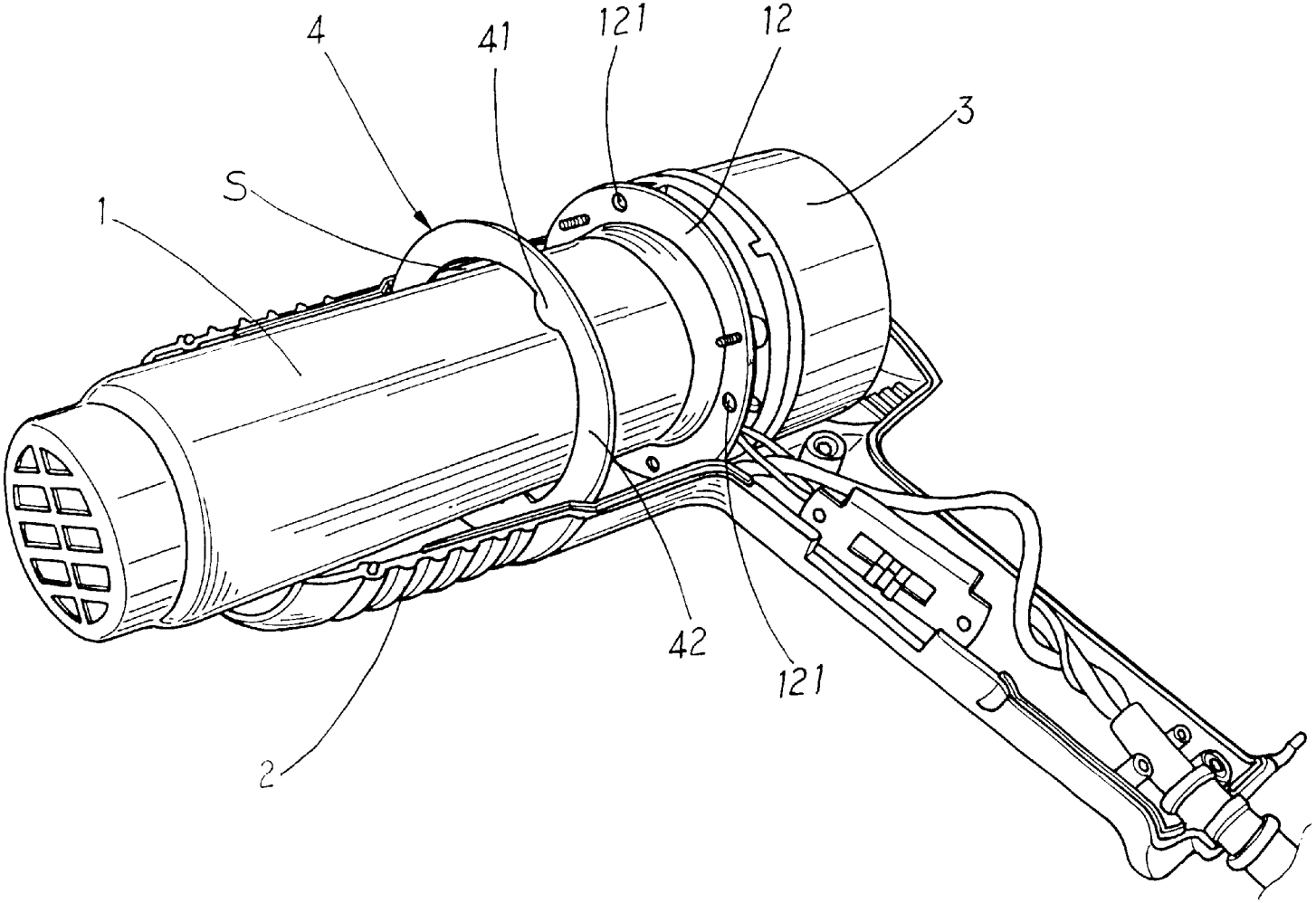
FIG. 3 is a cutaway view of the safety hot air blowing gun according to the present invention.

Referring to FIGS. 2 and 3, a hot air blowing gun is shown comprising a housing 2, an inner barrel 1 mounted inside the housing 2, a high-impedance resistance type heating element 11 mounted in the inner barrel 1, a nozzle tip (not shown) mounted in the front side of the housing 2, and a fan motor assembly 3 mounted inside the housing 2 and disposed at the rear side of the inner barrel 1 and controlled to blow air through the inner barrel 1 and the nozzle tip to the outside of the housing 2 for application.

A heat-resisting protective ring 4 is mounted inside the housing 2 to support the inner barrel 1. The protective ring 4 comprises a plurality of protruded portions 41 inwardly protruded from the inner diameter and respectively abutted against the peripheral wall of the inner barrel 1. When installed, open spaces S are left within the peripheral wall 42 of the protective ring 4 around the peripheral wall of the inner barrel 1.

Figure 4:
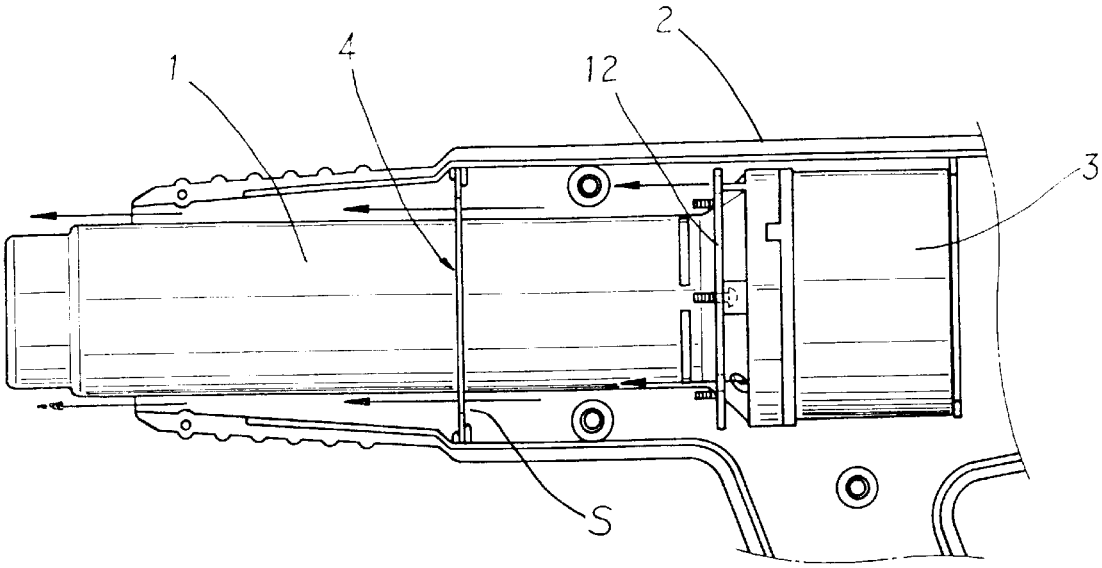
FIG. 4 is a side view of the present invention, showing currents of air passed through the open spaces within the protective ring around the inner barrel.

Referring to FIG. 4 and FIG. 3 again, when starting the fan motor assembly 3, currents of air are produced and blown through the inside space of the inner barrel 1 over the heating element 11 as well as the open spaces S outside the inner barrel 1 inside the housing 2.

The currents of air passing through the open spaces S outside the inner barrel 1 reduce the temperature of the inner barrel 1 and the temperature of the protective ring 4. Because the contact area between the protective ring 4 and the inner barrel 1 is limited to the protruded portions 41, little heat is transmitted from the inner barrel 1 to the housing 2, preventing the housing 2 from deformation due to high temperature.

Referring to FIGS. 3 and 4 again, the inner barrel 1 comprises an outward mounting flange 12 extended around the periphery of the rear side thereof, and a plurality of air vents 121 extended through the outward mounting flange 12. The fan motor assembly 3 is fixedly fastened to the outward flange 12 of the inner barrel 1. When starting the fan motor assembly 3, a part of the induced currents of air passes through the inside of the inner barrel 1, and the other part of the induced currents of air passes through the air vents 121 on the outward flange 12 and the open spaces S within the protective ring 4 around the inner barrel 1 to lower the temperature of the peripheral wall of the inner barrel 1 and the protective ring 4.

Figure 5:
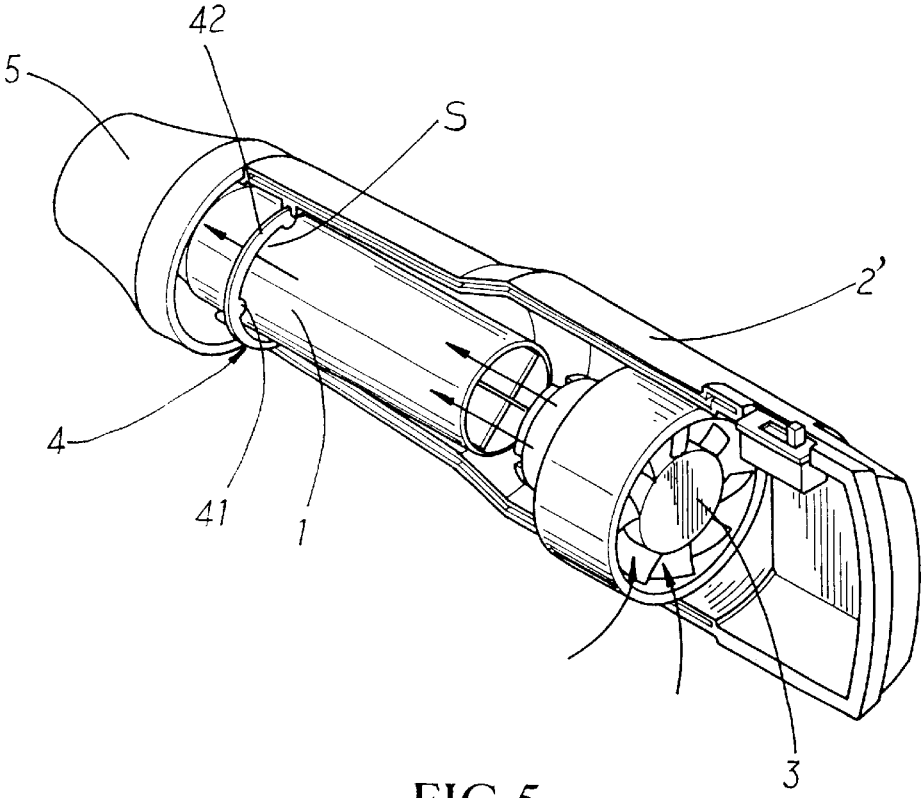
FIG. 5 is a cutaway of an alternate form of the present invention, showing currents of air passes through the open spaces within the protective ring around the inner barrel.

FIG. 5 shows the protective ring 4 mounted around an inner barrel 1 inside the housing 2' of another structure of hot air blowing gun. A tapered nozzle cap 5 is coupled to the front side of the housing 2' to guide currents of air passing through the open spaces S within the protective ring 4 around the inner barrel 1 to the outside of the hot air blowing gun around the front nozzle tip.

As indicated above, the arrangement of the protective ring greatly reduces the contact area between the inner barrel and the housing, and therefore less heat is transmitted from the inner barrel to the housing during the operation of the hot air blowing gun. Because a part of the induced currents of air from the fan blade assembly is guided to pass through the open spaces within the protective ring around the inner barrel, the contact temperature between the inner barrel and the housing is greatly reduced. Further, the protective ring can be moved along the inner barrel to fit the housing of any of a variety of hot air blowing gun designs.

A prototype of safety hot air blowing gun has been constructed with the features of FIGS. 2~5. The safety hot air blowing gun functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A safety hot air blowing gun comprising a cylindrical housing having a front side and a rear side, an inner barrel mounted inside said housing, said inner barrel having a front side and a rear side, a high-impedance resistance type heating element mounted around an inside wall of said inner barrel, a nozzle tip fastened to the front side of said housing, said nozzle tip having a front side and a rear side, and a fan motor assembly mounted inside said housing and aimed at the rear side of said inner barrel and controlled to blow air through said inner barrel and said nozzle tip, said inner barrel comprises an outward flange extended around the rear side thereof and adapted to support said fan motor assembly, said outward flange having a plurality of air vents respectively; characterized in that:

a heat-resisting protective ring is mounted inside said housing to support said inner barrel, said protective ring comprising a plurality of protruded portions protruded from the inner diameter thereof and respectively abutted against a periphery of said inner barrel and defining with said protective ring and the periphery of said inner barrel of a plurality of open spaces for the passing of currents of air from said fan motor assembly.

* * * * *